US005577483A

United States Patent [19]

Suedholt et al.

[11] Patent Number: 5,577,483

[45] Date of Patent: Nov. 26, 1996

[54] METHOD FOR CORRECTION OF STARTING INJECTION TIMING

[75] Inventors: Michael Suedholt, Koefering; Manfred Wier, Wenzenbach, both of Germany

[73] Assignee: Siemens Aktiengesellschaft, Munich, Germany

[21] Appl. No.: 306,758

[22] Filed: Sep. 15, 1994

[30] Foreign Application Priority Data

Sep. 15, 1993 [EP] European Pat. Off. ..... 93114840

[51] Int. Cl.[6] ..... F02D 41/06

[52] U.S. Cl. ..... 123/491

[58] Field of Search ..... 123/488, 491, 123/494

[56] References Cited

U.S. PATENT DOCUMENTS

| | | | |
|---|---|---|---|
| 4,348,727 | 9/1982 | Kobayashi et al. | 123/681 X |
| 4,708,115 | 11/1987 | Yamato et al. | 123/494 |
| 4,814,997 | 3/1989 | Matsumura et al. | 123/488 X |
| 4,864,998 | 9/1989 | Onishi | 123/494 X |
| 4,907,556 | 3/1990 | Ishii et al. | 123/486 |
| 4,907,557 | 3/1990 | Ishii et al. | 123/488 |
| 4,938,195 | 7/1990 | Miyazaki et al. | 123/488 |

FOREIGN PATENT DOCUMENTS

| | | |
|---|---|---|
| 0478120 | 4/1992 | European Pat. Off. . |
| 0575635 | 12/1993 | European Pat. Off. . |
| 4134522 | 4/1992 | Germany . |
| 94/02730 | 2/1994 | WIPO . |

*Primary Examiner*—Tony M. Argenbright
*Attorney, Agent, or Firm*—Herbert L. Lerner; Laurence A. Greenberg

[57] ABSTRACT

A method for adapting a starting injection timing to a pressure of ambient air includes storing in memory a correction factor representing an ambient air pressure when an engine is turned off. A value for a starting injection timing is modified with the correction factor, upon a starting process.

4 Claims, 1 Drawing Sheet

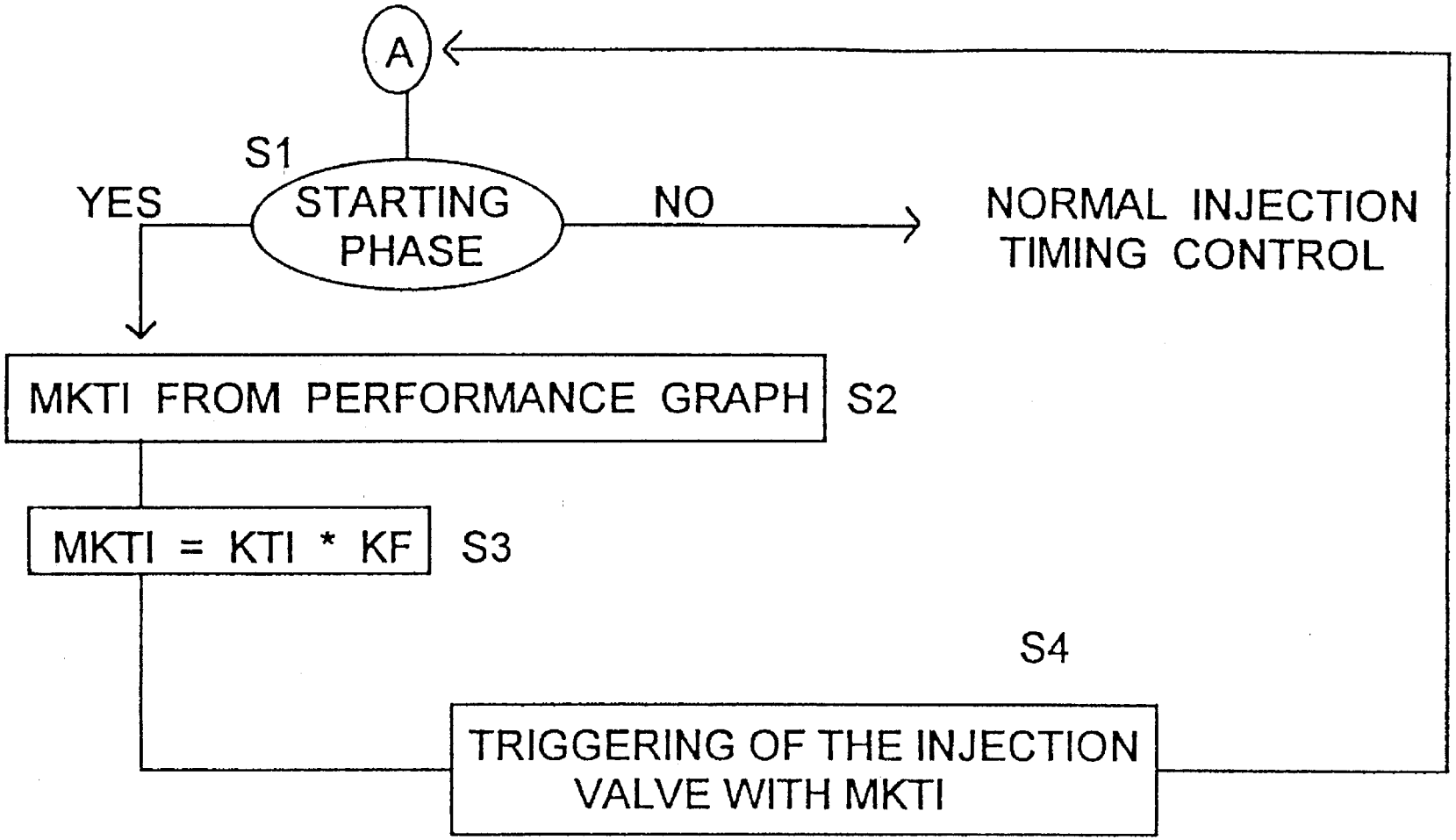
A
S1
STARTING PHASE
YES
NO
NORMAL INJECTION TIMING CONTROL
S2
MKTI FROM PERFORMANCE GRAPH
S3
MKTI = KTI * KF
S4
TRIGGERING OF THE INJECTION VALVE WITH MKTI

METHOD FOR CORRECTION OF STARTING INJECTION TIMING

BACKGROUND OF THE INVENTION

FIELD OF THE INVENTION

The invention relates to a method that makes it possible to adapt an injection timing which is specified for starting internal combustion engines, to currently prevailing variables of the ambient air.

In internal combustion engines, a depletion of the aspirated fuel-air mixture taken place upon starting, especially cold starting. That is because of the low fuel evaporation and marked moistening of the wall with the fuel. Moreover, at the low rpm of the starter, poor turbulence of the fuel particles is achieved. In order to compensate therefor, additional fuel is injected upon starting. There are major rpm fluctuations during the starting process, making the signal furnished by the air flow rate meter unreliable. Fixed injection timing values are therefore specified and stored in memory in a performance graph, as a function of the engine temperature or coolant temperature, as is described, for instance, in German Published, Non-Prosecuted Application DE 41 34 522 A1. Those injection timing values were ascertained for a certain air pressure (standard pressure), for instance on a test bench. However, if an air pressure other than standard pressure prevails at the actual moment of starting, then the wrong injection timing values are obtained. One result is overenrichment of the fuel-air mixture, for instance, if the vehicle is at higher altitudes.

SUMMARY OF THE INVENTION

It is accordingly an object of the invention to provide a method for correction of starting injection timing, which overcomes the hereinafore-mentioned disadvantages of the heretofore-known methods of this general type and which makes it possible to adapt injection timing values for a starting phase to a changing ambient air pressure at a moment of starting.

With the foregoing and other objects in view there is provided, in accordance with the invention, a method for adapting a starting injection timing to a pressure of ambient air, which comprises storing in memory a correction factor representing an ambient air pressure when an engine is turned off; and modifying a value for a starting injection timing with the correction factor, upon a starting process.

It is therefore seen that the object of the invention is attained by modifying values for the starting injection timing which are read out from a performance graph, with an air-pressure-dependent correction factor.

A pressure gauge can be used for that purpose, with which the ambient air pressure is ascertained at the moment of starting. However, that is rather complicated because of the additional ambient air pressure gauge, which is not provided in typical engine control units. It is therefore more advantageous to use a value for pressure correction that is furnished by the engine control unit from other control processes. Any arbitrary value that represents the ambient air pressure can be used for that purpose.

One such variable representing the ambient air pressure is furnished by the engine control unit in calculating the air flow rate, for instance. In the normal situation, the mass of air flowing into the engine is measured by an air flow rate meter. In air flow rate meters that have a high response speed, the output signal of the air flow rate meter follows every pulsation in the air flow. Masses of air flowing backward as well, as occurs when there are pulsations in the intake air, are mistakenly detected as well.

Once such pulsations are detected, the measured values can no longer be used. Predetermined values from a substitute performance graph are used instead, as is described in Published European Application No. 0 575 635 A1. Those values were ascertained beforehand on the test bench for a specific ambient air pressure (standard pressure). Those substitute air values must then likewise be adapted to the actual ambient air pressure. As is described in Published International Application WO 94/02730, for instance, that is done by comparing the air value measured in pulsation-free periods with the corresponding substitute air value from the substitute performance graph. That comparison yields a variable (called an adaptation factor) that represents the ambient air pressure. The most recently calculated adaptation factor, or the adaptation factor obtained from sliding averaging, is stored in non-volatile fashion when the engine is turned off. The next time the engine is started, that factor then serves as a correction factor for calculating the injection timing.

Although the invention is illustrated and described herein as embodied in a method for correction of starting injection timing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The drawing FIGURE is a flow chart in conjunction with which the invention will be described in further detail below.

DESCRIPTION OF THE PREFERRED EMBODIMENTS

Referring now to the single FIGURE of the drawing in detail, it is seen that at a start A of the method, in a method step S1, a check is made, for instance from the engine rpm, as to whether or not the engine is in the starting phase. If not, the normal injection control ensues. However, if the engine is in the starting phase, then in a method step S2 the value for a starting injection timing KTI is taken from a performance graph as a function of the coolant temperature. In a method step S3, this starting injection timing KTI is multiplied by a correction factor KF, which is taken from a memory in which it was stored in non-volatile fashion after the engine was turned off. This value KF is set at 1 the first time the engine is started. Then during engine operation, it is updated continuously, for instance through the adaptation factor, as described above, as that factor is ascertained for correction of the substitute air values being used instead of the measured values in the event of pulsations in the intake air. In this case, it is calculated, for instance, by the following formula:

$$KF=LW/LE * TF,$$

in which LW designates an air value measured by an air flow rate meter in the intake line of the engine, LE designates a substitute air value stored in memory in a performance graph, and TF designates a temperature factor, which is calculated by the following formula:

$$TF=\sqrt{\frac{293\text{ K.}}{t+273\text{ K.}}}\ .$$

When the engine is turned off, the most recently ascertained correction value KF is then stored in non-volatile memory. In a method step S4, the injection valve is triggered with this corrected injection value. A return is then made to the method start A.

We claim:

1. A method for adapting a starting injection timing to a pressure of ambient air, which comprises:

storing in a non-volatile memory a correction factor representing an ambient air pressure when an engine is turned off;

modifying a value for a starting injection timing with the correction factor stored in the storing step, upon a starting process, using an adaptation factor as the correction factor, using substitute air values in the event of pulsations in an intake air instead of values measured by an air flow rate meter, and adapting the substitute air values to the ambient air pressure with the adaptation factor.

2. The method according to claim 1, which comprises calculating the correction factor KF with the formula:

$$KF=LW/LE * TF,$$

in which LW designates the air value measured by the air flow rate meter in the intake tract of the engine, LE designates the substitute air value stored in memory in a performance graph, and TF designates a temperature factor which is calculated by the following formula:

$$TF=\sqrt{\frac{293\text{ K.}}{t+273\text{ K.}}}\ .$$

3. The method according to claim 1, which comprises subjecting the correction factor to a sliding averaging.

4. The method according to claim 1, which comprises setting the correction factor to 1 the first time the engine is started.

* * * * *